US007306434B2

(12) United States Patent
Goldfinch

(10) Patent No.: US 7,306,434 B2
(45) Date of Patent: Dec. 11, 2007

(54) REDUCTION OF CO-EFFICIENT OF FRICTION TO REDUCE STRESS RATIO IN BEARINGS AND GAS TURBINE PARTS

(75) Inventor: Keith Christopher Goldfinch, Bristol (GB)

(73) Assignee: Rolls-Royce plc, London (GB)

( * ) Notice: Subject to any disclaimer, the term of this patent is extended or adjusted under 35 U.S.C. 154(b) by 305 days.

(21) Appl. No.: 11/046,759

(22) Filed: Feb. 1, 2005

(65) Prior Publication Data

US 2005/0180852 A1 Aug. 18, 2005

(30) Foreign Application Priority Data

Feb. 12, 2004 (GB) ..... 0403064.9
Jan. 26, 2005 (GB) ..... 0501610.0

(51) Int. Cl.
*F01D 5/30* (2006.01)

(52) U.S. Cl. ..... 416/219 R; 416/248

(58) Field of Classification Search ..... 416/219 R, 416/248; 384/625
See application file for complete search history.

(56) References Cited

U.S. PATENT DOCUMENTS 3,809,495 A * 5/1974 Stahl ..... 416/135
4,169,694 A 10/1979 Sanday
5,264,295 A 11/1993 Yoshikawa et al.
5,356,545 A * 10/1994 Wayte ..... 416/219 R
5,573,377 A 11/1996 Bond et al.
5,846,054 A 12/1998 Mannava et al.
6,089,828 A * 7/2000 Hollis et al. ..... 416/219 R
2005/0084379 A1 4/2005 Schreiber

FOREIGN PATENT DOCUMENTS

EP 0 496 503 A1 7/1992
EP 1 484 475 A2 12/2004
WO WO 95/13191 5/1995

* cited by examiner

*Primary Examiner*—Richard A. Edgar
(74) *Attorney, Agent, or Firm*—Oliff & Berridge, PLC

(57) ABSTRACT

A rotor blade, a rotor disc (24) or load bearing assembly having at least one bearing surface (22) for contact with a corresponding bearing surface (28). At least one selected area of the bearing surface (30,32) which, in operation, is an area of alternating stress greater than about 50 MPa (peak to peak), is configured to have a co-efficient of friction lower than the remainder of the bearing surface (34). The selected area (30,32) having a co-efficient of friction lower than the remainder of the bearing surface (34) may be provided by the application of a dry film lubricant, with the remaining area(s) (34) of said bearing surfaces (22) being substantially free of the said coating.

19 Claims, 2 Drawing Sheets

REDUCTION OF CO-EFFICIENT OF FRICTION TO REDUCE STRESS RATIO IN BEARINGS AND GAS TURBINE PARTS

The present application claims priority of British Patent Application No. 0403064.9filed Feb. 12, 2004 and British Patent Application No. 0501610.0 filed Jan. 26, 2005. The disclosures of British Patent Application No. 0403064.9 and British Patent Application No. 0501610.0 including the specification, drawings, and claims are incorporated herein by reference in their entirety.

This invention relates to gas turbine engine rotor blades, discs and bladed discs, and in particular concerns the attachment of rotor blades in blade fixing slots in rotor discs.

Single tooth attachments, or dovetail attachments, are commonly used to secure fan and/or compressor blades to discs in gas turbine engines. Dovetail shaped blade roots are located in similarly shaped slots circumferentially spaced around the rim of the rotor disc. The dovetail attachment reacts the centrifugal force generated by the blade during engine operation by contact with the disc on flat bearing surfaces, commonly referred to as "flanks".

Dovetail root cracking is a common occurrence in gas turbine engines due to high stress concentrations at the upper edge of contact (EOC) which are not adequately predicted by known finite element methods due to the extremely high stress gradients present at the edge of contact. Other factors that contribute to dovetail cracking include high coefficients of friction at the contact surfaces, high frequency blade excitation (high cycle fatigue) and fretting due to movement of the contact surfaces of the dovetail attachment. Dry-film-lubricant (DFL) is commonly applied to the contact surfaces of the dovetail attachment, principally to reduce fretting but also to reduce the coefficient of friction at the contact surfaces. Dry-film-lubricants have a tendency to degrade relatively quickly in gas turbine engine applications due to heavy loading and wear, with the rate of wear varying along the length of the dovetail contact surfaces.

There is a requirement to reduce the incidents of dovetail root cracking in fan and compressor blades in gas turbine engine applications, or other load bearing surfaces where the contact surfaces are subject to both steady state and dynamic contact stresses during operation.

According to an aspect of the invention there is provided a rotor blade for a gas turbine engine, the blade having a root for fixing the blade in a blade fixing slot provided in the rim of a rotor disc, the root having at least one bearing surface on each of its flanks for contact with corresponding surfaces on opposite sides of the said slot, wherein at least one selected area of the bearing surface of the root which, in operation, is an area of alternating stress greater than about 50 MPa (peak to peak), is configured to have a co-efficient of friction lower than the remainder of the bearing surface.

Preferably the selected areas the at least one selected area is provided by the application of a dry film lubricant to said at least on selected area, with the remaining area(s) of said bearing surfaces being substantially free of the said coating.

According to another aspect of the invention there is provided a rotor disc for a gas turbine engine, the disc having a plurality of blade root fixing slots circumferentially spaced around the rim of the disc-for fixing respective blades to the disc; each slot having at least one bearing surface on each side of the slot for contact with corresponding surfaces on opposite flanks of a blade, wherein at least one selected area of the bearing surface of each slot which, in operation, is an area of alternating stress greater than about 50 MPa (peak to peak), is configured to have a co-efficient of friction lower than the remainder of the slot surface.

Preferably the selected areas the at least one selected area is provided by the application of a dry film lubricant to said at least one selected area, with the remaining area(s) of said bearing surfaces being substantially free of said coating.

The present invention is based on observations that a relationship exists between the coefficient of friction of the bearing surfaces and blade root steady stresses with high blade root friction resulting in high steady stresses. The present inventor has demonstrated that where the coefficient of friction varies along the contact surfaces of the dovetail root, due to degradation of a dry-film-lubricant applied to the surfaces, the areas having a relatively high coefficient of friction are more highly loaded than areas where the lubricant is not degraded and where a relatively low coefficient of a friction exists. Where the coefficient of friction varies along the length of the dovetail contact surfaces the areas of high coefficient of friction take proportionately more load in terms of steady stress than areas of low coefficient of friction, effectively off loading the areas having a low coefficient of friction. In comparison, however, dynamic loads resulting in cyclic stresses on the contact surfaces are substantially independent of the coefficient of friction of the surface. Cyclic stresses are substantially due to the vibration mode shape of the blade and therefore only specific sections of the blade root are exposed to high alternating stress, for example the leading and trailing edges. As a result dovetail root cracking is more prevalent where high steady stresses occur due to breakdown of a friction reducing coating in combination with relatively high alternating stresses due to blade vibration. The combination of high steady and alternating stresses leads to high stress ratios and therefore reduced fatigue life. A "high" alternating stress can be taken to be any stress greater than about 50 MPa (peak to peak).

The "stress ratio" is defined as the ratio of actual alternating stress of the allowable alternating stress for failure in $10^7$ cycles at a given steady stress. A stress ratio of greater than about 40% in the examples presented will result in failure of the components. Hence a stress ratio of greater than 40% is taken to be a "high" stress ratio.

Hitherto, dry-film-lubricant has been applied to compressor/fan blade and disc dovetail roots along the whole flank (contact surfaces), principally to reduce root fretting but also to reduce coefficient of friction and therefore steady stresses. The present invention uses the principle of varying the co-efficient of friction of contact surfaces to optimise stresses within the blade root and in particular the stress ratio distribution along the length of the contact surfaces (flanks) of the blade root. The present invention enables the distribution of steady stresses to be manipulated by, for example, using selective application of dry-film-lubricant to areas of high alternating stress thereby offloading at least part of the load generating the high steady stresses to areas of low alternating stress. In this way it is possible to optimise the stress ratio distribution over the whole of the blade root contact surfaces to ensure that no area of the contact surface is subject to both high alternating and steady stresses. This readily enables the maximum stress ratio to be reduced for particular engine operating conditions.

The bearing surfaces of the rotor blade root each comprise a leading edge end and a trailing edge end. Preferably the region configured to have a low co-efficient of friction is a region where the stress distribution along the flanks requires it and is configured in such a manner as to achieve the desired result. In one example a dry film lubricant coating is applied to the root in the region of the leading edge end and/or the trailing edge end. In this way, in embodiments where the alternating stresses are highest at the leading and trailing edge ends of the root bearing surfaces, for example due to blade vibration, the steady state contact stresses can be reduced in these areas by the selective application of a dry-film-lubricant to these areas with the region between the trailing and leading edge ends being substantially free of lubricant. This can be readily achieved by masking the middle portion of the root bearing surfaces during the application of the dry-film-lubricant to the respective leading and trailing edge ends of the surfaces. This has the effect of reducing the stress ratio where the lubricant is applied but increasing the stress ratio where lubricant is not applied such that the stress ratio distribution along the length of the root contact surfaces is substantially uniform. In this way the maximum ratio of minimum to maximum stress is substantially reduced when compared with a root having a wholly uncoated or wholly coated bearing surface. In the context of the present invention it is to be understood that the terms "leading edge" and "trailing edge" relate to the aerofoil leading and trailing edge at opposite ends of the blade.

The selected area(s) having a relatively low co-efficient of friction may be between 40-70% of the surface area of the bearing surfaces. Alternatively the selected area(s) having a relatively low co-efficient of friction may be between 20-60% of the surface area of the bearing surfaces.

The selected area(s) may cover substantially the same size areas of the bearing surfaces at the leading and trailing edge ends. This is particularly desirable where the alternating stresses acting on the contact bearing surfaces are of similar magnitude at the leading and trailing edge end of the blade root.

Preferably, the root comprises a dovetail root having a substantially flat bearing surface on each flank of the root. However, the invention also contemplates other types of blade fixing roots, for example fir tree roots, having a plurality of load bearing lands.

Preferably, the rotor blade comprises a fan or compressor blade having a dovetail root.

The selective area(s) to which is configured to have a relatively low co-efficient of friction is/are subject to dynamic contact stresses, during engine operation, greater than the average of the dynamic contact stresses on the bearing surface due to blade vibration.

In preferred embodiments of the bladed rotor disc assembly the areas of relatively low co-efficient of friction on the respective bearing surfaces of the blade root and the disc slot are arranged such that they are in contact with each other in the disc assembly. In this way the stress ratio generated at the mating contact surfaces can be minimised.

According to another aspect of the invention there is provided a method of applying a dry film lubricant coating to a load bearing surface of gas turbine engine component, the said method comprising the steps of determining the distribution of steady and cyclic stresses acting on the said bearing surface of the uncoated component under engine operating conditions, determining the stress ratio distribution for the said uncoated surface under the said operating conditions, applying a dry film lubricant to area(s) of the bearing surface having a stress ratio above a pre-determined stress ratio threshold value. This method readily enables the stress ratio distribution over the whole of the bearing surface to be optimised so that no area of the bearing surface is subject to both high cyclic and high mean stresses under engine operating conditions.

According to a further aspect of the invention there is provided a load bearing assembly comprising at least one pair of load bearing surfaces in contact with each other for supporting steady state and dynamic loads in use, and at least one selected area on at least one of the bearing surfaces which, in operation, is an area of alternating stress greater than about 50 MPa (peak to peak), is configured to have a co-efficient friction lower than the remainder of the bearing surfaces.

Preferably the selected areas have a co-efficient the at least one selected area is provided by the application of a dry film lubricant to said at least one selected area, with the remaining area(s) of said bearing surfaces-being substantially free of the said coating.

An embodiment of the present invention will now be more particularly described, by way of example only, with reference to the accompanying drawings, in which.

Figure 1:
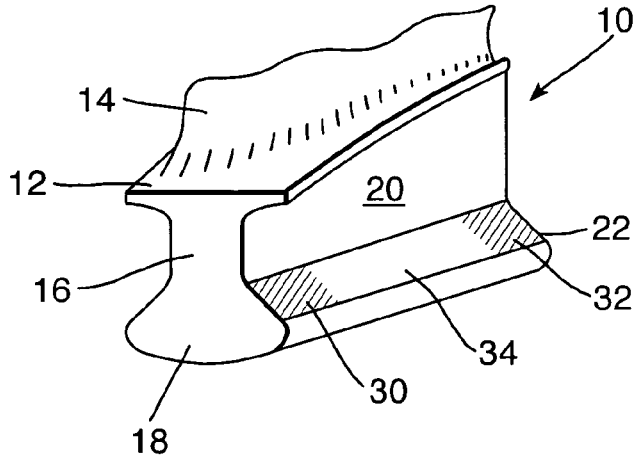
FIG. 1 is a schematic view-of the root section of a gas turbine engine fan blade.
Figure 2:
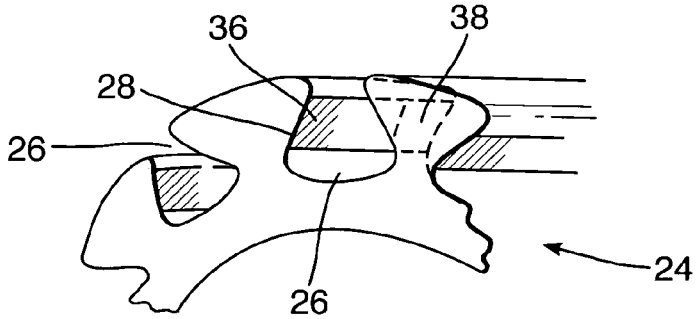
FIG. 2 is a schematic view of the rim section of a gas turbine engine fan rotor disc.

Configuring selected areas of bearing surfaces of highly loaded components to have a lower co-efficient of friction than adjacent areas finds particular application to gas turbine engine components as shown in FIGS. 1 and 2. One means by which this can be achieved is the selective application of dry film lubricant to selected areas. The selective application of dry-film-lubricant to the components shown in FIGS. 1 and 2 is discussed in relation to the fan section of a gas turbine engine. However, the present invention is equally applicable to the compressor stages of the engine as well as the fan.

FIG. 1 shows the root section 10 of a gas turbine engine fan blade. The majority of the fan blade is not shown in the drawing of FIG. 1 since the embodiment of the present invention discussed with reference to FIG. 1 is applicable to the root section only. The remaining detail of the aerofoil section is therefore not shown. The root section is disposed on the underside of the blade platform 12 with the aerofoil section 14 of the blade on the opposite side thereof. The root section is in the form of a dovetail root and comprises a root shank 16 and a dovetail shaped end section 18. The root shank 16 has a substantially constant cross section area in the spanwise direction of the blade as defined by a pair of generally parallel side flank surfaces 20 on opposite sides of the blade. The dovetail section 18 comprises a pair of inclined bearing surfaces 22, which diverge by equal amounts in the spanwise direction of the blade away from the blade platform 12. The underside of the root 18 between the bearing surfaces 22 is slightly rounded to give the dovetail end shape.

Figure 3:
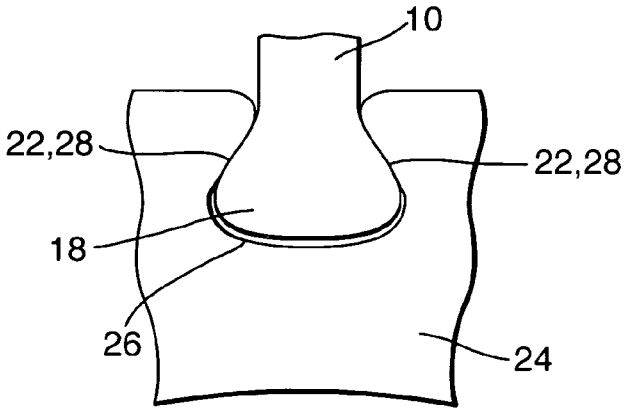
FIG. 3 is a cross section view of the root of the fan blade shown in FIG. 1 located in a slot in the rim of the disc shown in FIG. 2.

Referring now to FIG. 2 which shows part of the radially outer periphery of a fan disc 24 having a plurality of dovetail slots 26 circumferentially spaced around the periphery and opening radially for receiving respective dovetail root fan blades 10. Each dovetail slot 26 comprises a pair of inclined bearing surfaces 28, on opposite sides of the slot that diverge from the outer periphery towards the hub of the disc. The angle of divergence of the bearing surfaces 28 is the same as the angle of divergence of the bearing surfaces 22 with the dimensions of the slot being such that the blade root sections 10 slide into the slots to be attached to the disc as shown in the drawing of FIG. 3.

When the engine is stationary the dovetail roots 22 rest in the slots 26. During operation the rotational forces generated by the rotor blades cause the root bearing surfaces 22 to contact the slot bearing surfaces 28 so that the centrifugal force generated by the rotating fan blades is transferred to the disc 24 by the mating surfaces 22, 28. The magnitude of the force is a function of the rotational speed of the bladed rotor assembly and therefore the higher the operational speed of the rotor the greater the loading on the bearing surfaces 22, 28.

The steady stresses acting on the surfaces 22, 28 constitute steady stresses since they are principally dependent on the speed of rotation of the engine shaft to which the fan is attached to and at constant shaft speeds, combined with the friction at the interface between the two components. During engine operation the contact surfaces 22, 28 are also subject to high frequency cyclic contact stresses due to vibration of the fan blades in the slots 26.

In an embodiment of the present invention the deleterious effects of the combined steady (or mean) and alternating stresses acting on the bearing surfaces 22 of the dovetail roots are mitigated by configuring selected areas of the bearing contact surfaces 22 to have a lower co-efficient of friction than the remainder of the surface. This is achieved by the selective application of a dry-film-lubricant to selective areas of the bearing contact surfaces 22. In the drawing of FIG. 1 a dry-film-lubricant is applied to the leading edge end 30 and the trailing edge end 32 of the bearing surfaces 22. The dry-film-lubricant is applied over the whole width of the bearing surfaces at the leading and trailing edge ends with the central region 34 of the surface 22 between the ends 30 and 32 being substantially free of the dry-film-lubricant coating. The area of the central section 34 of the bearing surfaces 22 constitutes about 50% of the total surface area of the bearing surface 22 with the coated areas 30 and 32 being of substantially equal area and each comprising about 25% of the total surface area.

Selective areas of the bearing surfaces 28 of the dovetail slots are also provided with a dry-film-lubricant surface coating. Dry-film-lubricant is applied to the surfaces 28 at the opposite ends of the slot such that the coated region 30 on the blade root bearing surface 22 contacts a coated region 36 at the leading edge side of the disc slot, and the coated region 32 at the trailing edge end of the blade root contacts a region 38 at the trailing edge end of the slot. The dimensions of the coated regions 30 and 36 and 32 and 38 are such that the coated regions of the root and the slot are substantially the same and in contact with each other in the bladed disc assembly.

Figure 4:
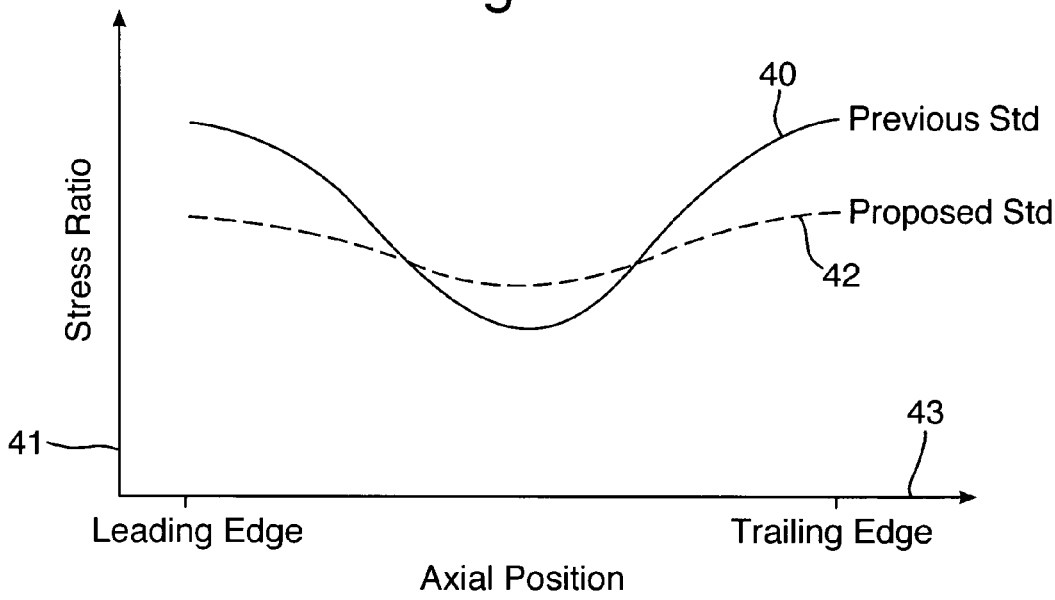
FIG. 4 shows the distribution of stress ratio along the bearing surfaces of the fan blade root of FIG. 1 for different applications of dry-film-lubricant.

FIG. 4 shows the variation of the stress ratio of the steady and alternating stresses acting on the bearing surface 22 of the blade root from the leading edge end to the trailing edge end at a particular engine operating condition. The "Y" axis 41 represents the stress ratio value and the "X" axis 43 represents the distance along the root from the trailing edge to the leading edge and thereof. The solid line 40 in the drawing of FIG. 3 represents the stress ratio variation from the leading edge end (left hand side) to the trailing edge end (right hand side) of the bearing surface 22 where the whole of the surface is coated with a dry-film-lubricant. The broken line 42, on the other hand, represents the stress ratio variation where the bearing surface 22 is coated with dry-film-lubricant on selective areas 30 and 32 as shown in the drawing of FIG. 1. Comparing the stress ratio variations 40 and 42 it can be seen that while in both cases the stress ratio is a maximum at the leading edge end and the trailing edge end and a minimum at the mid point between the respective ends, the extent of variation is much less in the case of the part coated bearing surface shown in FIG. 1 than the fully coated surface represented by line 40. The stress ratio distribution shown in FIG. 4 demonstrates that the application of a dry-film-lubricant at the leading edge and trailing edge end regions 30 and 32 of the bearing surface 22 lowers the steady (mean) stress at these points and therefore lowers the stress ratio while increasing the steady (mean) stress along the central region 34 thereby increasing the stress ratio in this region. The reduction in mean stress at the leading and trailing edge ends of the bearing surface 22 has the effect of increasing the fatigue life of the dovetail root at these regions where cracking has been known to occur in dovetail roots having fully coated surfaces 22.

Figure 5:
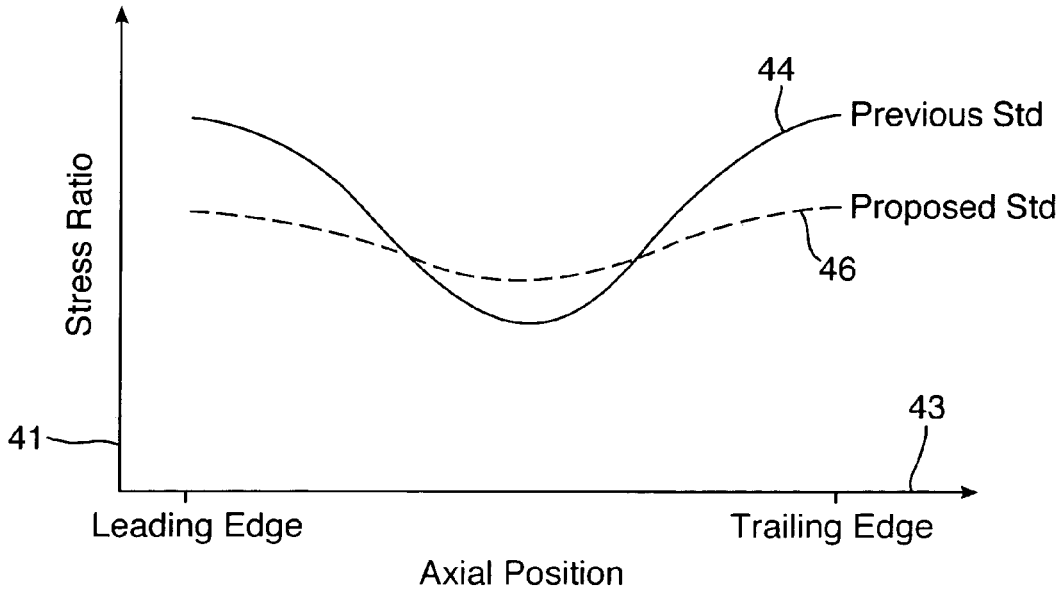
FIG. 5 shows the distribution of stress ratio along the bearing surfaces of the fan blade root of FIG. 2 for different applications of dry-film-lubricant.

FIG. 5 shows the variation of stress ratio between the leading edge (left hand side) and trailing edge (right hand side) end of the bearing surface 28 of a dovetail slot. Line 44 represents the stress ratio variation along the length of the slot for a fully coated bearing surface 28 while line 46 represents the stress ratio variation for the part coated bearing surface 28 shown in and described with reference to FIG. 2. The stress ratio variation shown in FIG. 5 is very similar to that shown in FIG. 4 with the fully coated bearing surface 28 having a higher stress ratio at the leading edge and trailing edge ends and a lower stress ratio at the central part of the bearing surface when compared with the stress ratio variation 46 for the part coated bearing surface 28.

Although aspects of the invention have been described with reference to the embodiments shown in the accompanying drawings, it is to be understood that the invention is not limited to the precise embodiment shown and that various changes and modifications may be effected without further inventive skill and effort. For example, the invention is applicable to any type of bearing surface which is in contact with another surface for supporting steady state and dynamic loads where the dynamic loads are not evenly distributed over the surface.

The invention claimed is:

1. A rotor blade for a gas turbine engine, the blade having a root for fixing the blade in a blade fixing slot provided in a rim of a rotor disc, the root having at least one flank and at least one bearing surface on each flank for contact with corresponding surfaces on opposite sides of the slot, wherein a dry film lubricant coating is provided on a selected area of the at least one bearing surface, with a remaining area of the at least one bearing surface being substantially free of the coating, the coating on the selected area being distributed in a predetermined pattern.

2. A rotor blade as claimed in claim 1 wherein the at least one bearing surface comprises a leading edge end and a trailing edge end and the selected area is provided in a region of at least one of the leading edge end and the trailing edge end.

3. A rotor blade as claimed in claim 2 wherein each selected area is of substantially the same size.

4. A rotor blade as claimed in claim 1 wherein the selected area is between 40 and 70 percent of an area of the at least one bearing surface.

5. A rotor blade as claimed in claim 1 wherein the root comprises a dovetail root having a substantially flat bearing surface on each flank of the root.

6. A rotor blade as claimed in claim 1 wherein the blade comprises a fan or compressor blade.

7. A rotor blade as claimed in claim 1 wherein the selected area is subject to dynamic contact stresses, in use, greater than an average dynamic contact stress on the at least one bearing surface.

8. A rotor disc for a gas turbine engine, the disc having a plurality of blade root fixing slots circumferentially spaced around the rim of the disc for fixing respective blades to the disc; each slot having at least one bearing surface on each side of the slot for contact with corresponding surfaces on opposite flanks of a blade, wherein a dry film lubricant is provided on a selected area of the at least one bearing surface on each side of the slot, with a remaining area of the at least one bearing surface being substantially free of the coating, the coating on the selected area being distributed in a predetermined pattern.

9. A rotor disc as claimed in claim 8 wherein each of the at least one bearing surface comprises a leading edge end and a trailing edge end and the selected area is provided in a region of at least one of the leading edge end and the trailing edge end.

10. A rotor disc as claimed in claim 9 wherein each selected area is of substantially the same size.

11. A rotor disc as claimed in claim 8 wherein the selected area is between 20 and 60 percent of an area of the at least one bearing surface.

12. A rotor disc as claimed in claim 8 wherein the selected area is between 40 and 70 percent of an area of the at least one bearing surface.

13. A rotor disc as claimed in claim 8 wherein each slot comprises a dovetail slot having a substantially flat bearing surface on each side of the slot.

14. A rotor disc as claimed in claim 8 wherein the disc comprises a fan or compressor disc.

15. A rotor disc as claimed in claim 8 wherein the selected area is subject to dynamic contact stresses, in use, greater than an average dynamic contact stress on the at least one bearing surface.

16. A load bearing assembly comprising at least one pair of load bearing surfaces in contact with each other for supporting steady state and dynamic loads in use, and a dry film lubricant provided on a selected area of the at least one pair of load bearing surfaces with a remaining area of the at least one pair of load bearing surfaces being substantially free of the coating, the coated and uncoated areas being distributed in a predetermined pattern, wherein the selected area of one of the load bearing surfaces of the each pair of load bearing surfaces is arranged to be in contact with the selected area of the other load bearing surface of the at least one pair of load bearing surfaces.

17. An assembly as claimed in claim 16 wherein the selected area is subject to dynamic contact stresses, in use, greater than the average dynamic contact stress on the at least one pair of load bearing surfaces.

18. A gas turbine engine assembly or sub-assembly comprising at least one load bearing assembly as claimed in claim 16.

19. A method of applying a dry film lubricant coating to a load bearing surface of gas turbine engine component, the method comprising:

determining a distribution of steady and cyclic stresses acting on the load bearing surface of an uncoated component under engine operating conditions, determining a stress ratio distribution for an uncoated load bearing surface under the operating conditions, and applying a dry film lubricant to only a selected area of the load bearing surface, the selected area of the load bearing surface having a stress ratio above a predetermined stress ratio threshold value.

* * * * *